United States Patent [19]

Blazek

[11] 4,043,379

[45] Aug. 23, 1977

[54] METHOD OF MAKING A MOLD

[75] Inventor: William S. Blazek, Valley City, Ohio

[73] Assignee: TRW Inc., Cleveland, Ohio

[21] Appl. No.: 676,227

[22] Filed: Apr. 12, 1976

[51] Int. Cl.[2] ..... B22C 9/04; B22C 7/02

[52] U.S. Cl. ..... 164/23; 164/34; 164/249

[58] Field of Search ..... 164/25, 26, 165, 166, 164/235, 245, 246, 249, 34, 35, 36, 23

[56] References Cited

U.S. PATENT DOCUMENTS

| | | | |
|---|---|---|---|
| 2,994,931 | 8/1961 | Operhall et al. | 164/246 |
| 3,868,986 | 3/1975 | Olsen | 164/246 X |

FOREIGN PATENT DOCUMENTS

| | | | |
|---|---|---|---|
| 644,941 | 7/1964 | Belgium | 164/34 |

*Primary Examiner*—Ronald J. Shore

[57] ABSTRACT

An improved method of making a ceramic mold having a cavity in which a cast product is accurately formed includes reinforcing relatively flexible wax pattern material having a configuration which corresponds to the configuration of the mold cavity. Supporting the flexible pattern material with a relatively rigid reinforcing member prevents the pattern material from deflecting during removal from the injection die, pattern storage, pattern and gating assembly and dipping of the pattern in liquid ceramic mold material. Between dipping steps, portions of a wet ceramic coating are wiped away in areas between portions of the wet coating which will eventually form mold sections. After the ceramic mold material on the pattern has been dried, the pattern material is destroyed by heating or other methods. The resulting mold sections are then separated and the rigid reinforcing member removed from between the mold sections. The separate mold sections are interconnected to form a cavity in which a cast product is accurately formed. In one specific case, a plurality of mold sections were interconnected to form a circular mold cavity for a turbine engine components.

14 Claims, 7 Drawing Figures

METHOD OF MAKING A MOLD

BACKGROUND AND SUMMARY OF THE INVENTION

The invention disclosed and claimed herein was made in the course of or under a contract, or subcontract thereunder, with the U.S. Air Force.

This invention relates generally to a method of making at least a portion of a ceramic mold having a cavity for accurately forming a cast product and more specifically to a method of accurately making ceramic mold surfaces by reinforcing relatively flexible pattern material to prevent flexing of the pattern material as it is dipped in a slurry of ceramic mold material.

Relatively large turbine engine components, such as diffuser cases, nozzle rings, vane assemblies, bearing supports and fan frames have been previously fabricated from a multitude of small castings, sheet panels, and forgings. An improved method of making a mold assembly for use in casting these products is disclosed in U.S. Pat. application Ser. No. 653,383, filed Jan. 29, 1976 by William S. Blazek, Thomas S. Piwonka, James D. Jackson and Philip N. Atanmo and entitled "Mold Assembly and Method of Making the Same".

The Blazek et al. application discloses a method wherein wax patterns are dipped in a slurry of ceramic mold material to eventually form a plurality of mold sections. The mold sections are interconnected to define a mold cavity in which a cast part is formed. During the assembly of a jet engine fan frame mold in the manner disclosed in the Blazek et al. application, it has been determined that dimensional errors resulted in the fan frame due to deflection of the relatively flexible wax pattern material during dipping of the patterns.

In accordance with a feature of the present invention, the dimensional accuracy with which cast parts are formed in ceramic molds is substantially increased by reinforcing the portion of the pattern which corresponds to the mold cavity in which a cast part is formed. This reinforcing retards deflection of the pattern during dipping in a liquid ceramic mold material. By reinforcing the portion of the pattern which is utilized to cast the inner or hub section of a jet engine fan frame, the amount of diametral error in a hub having a diameter of approximately 24 inches was reduced from approximately 0.360 inches to approximately 0.027 inches.

Heretofore, a cluster of wax patterns for forming cast products has been strengthened by providing relatively rigid reinforcing members in the gating and sprue cup associated with the pattern clusters. The manner in which this is done is disclosed in U.S. Pat. No. 2,994,931. Although reinforcing the gating associated with a cluster of patterns may, to a limited extent, tend to retard deflection of the patterns, it is believed that this arrangement is less than optimum to form a cast product.

In accordance with the present invention, the dimensional accuracy with which a cast product is formed is enhanced by providing reinforcing in the portion of the pattern corresponding to the cast product. It should be understood that as used herein in both the specification and claims, the term "cast product" means the final product of a casting operation and does not include any metal which may remain in the gating which is associated with the product during the casting operation. In this regard, it should be noted that during certain casting operations the gating may not even be completely filled with metal but will merely serve as a partially filled reservoir to supply the molten metal to the cast product. The dimensional accuracy with which the gating is formed is of minimal consequence while the dimensional accuracy with which the cast product is formed is of utmost importance.

Accordingly, it is an object of this invention to provide a new and improved method of making at least a portion of a ceramic mold having a cavity to accurately form a cast product and wherein the method includes the step of reinforcing relatively flexible pattern material having a surface which at least partially defines the surface of the mold cavity in which a cast product is formed to thereby retard deflection of the relatively flexible pattern material during dipping of the pattern material in liquid ceramic mold material.

Another object of this invention is to provide a new and improved method of making a ceramic mold to accurately form a cast product and wherein the method includes the steps of providing a plurality of pattern assemblies having bodies of relatively flexible and destructable pattern material with a surface area corresponding to a portion of the surface area of the cast product and a plurality of relatively rigid members which reinforce the associated bodies of pattern material. The reinforcing members are effective to retard deflection of the relatively flexible pattern bodies during dipping of the pattern bodies in a liquid ceramic mold material. The pattern bodies are destructable and the reinforcing members removable after dipping to provide a plurality of mold sections which can be interconnected to at least partially define the mold cavity in which the cast product is formed.

BRIEF DESCRIPTION OF THE DRAWINGS

These and other objects and features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
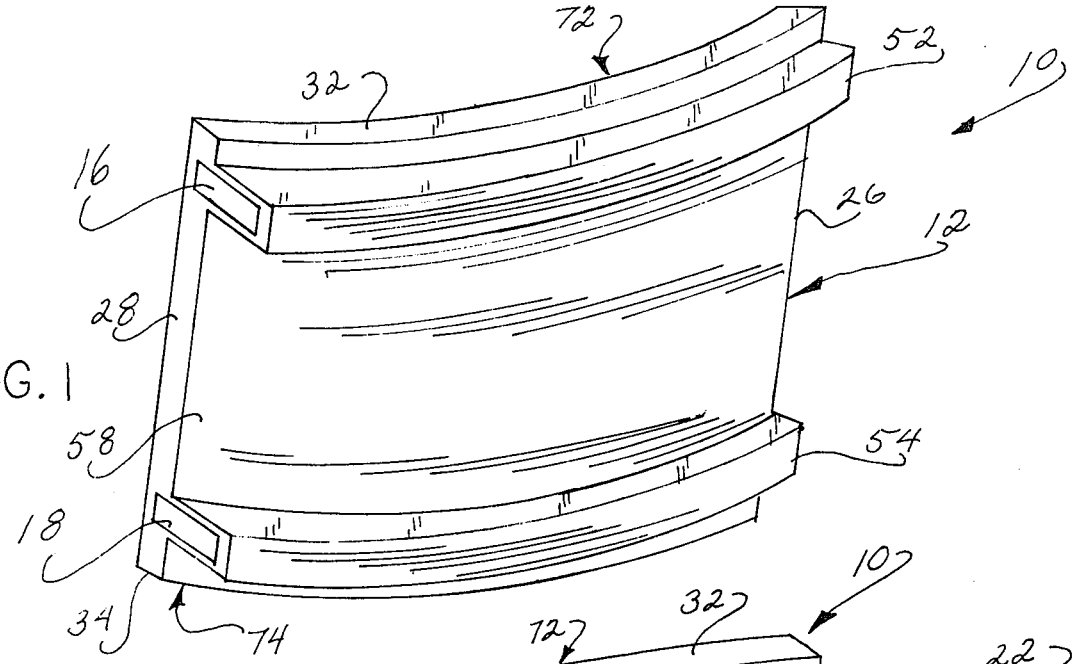
FIG. 1 is a schematic illustration of a pattern assembly constructed in accordance with the present invention.

A pattern assembly 10 constructed in accordance with the present invention includes a body 12 of relatively flexible and destructable pattern material, such as wax or plastic. Relatively rigid metal reinforcing members 16 and 18 are provided in the body 12 of pattern material to retard deflection of the pattern material. The pattern assembly 10 is advantageously held in a relatively rigid frame 22 (FIG. 2) as it is dipped in liquid ceramic mold material.

After the pattern assembly 10 has been dipped in liquid ceramic mold material, minor end surfaces 26 and 28 (see FIGS. 1 and 2) of the pattern assembly are wiped to at least partially remove the wet coating of ceramic mold material overlying these surfaces. In addition, arcuate flange surfaces 32 and 34 (see FIG. 1) are also wiped to remove the ceramic mold material. Although the surfaces 26, 28, 32 and 34 could be wiped after each of a series of dipping steps, it is contemplated that the wiping operation may be omitted after the first dipping step to form a relatively thin layer of ceramic mold material over the surfaces 26, 28, 32 and 34. The subsequent wet coatings of ceramic mold material are wiped away in the same manner as described in U.S. Pat. application Ser. No. 653,383, filed Jan. 29, 1976 by William S. Blazek et al. and entitled "Mold Assembly and Method of Making the Same".

Figure 3:
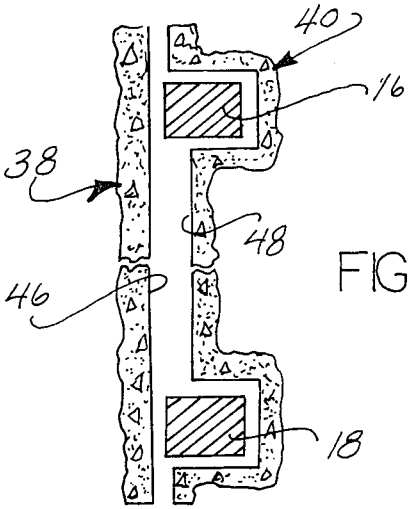
FIG. 3 is a schematic sectional view illustrating the relationship between a pair of mold sections or pieces formed by dipping the pattern assembly of FIG. 1 in ceramic mold material after destroying the body of relatively flexible and destructable pattern material and prior to removing of reinforcing members.
Figure 4:
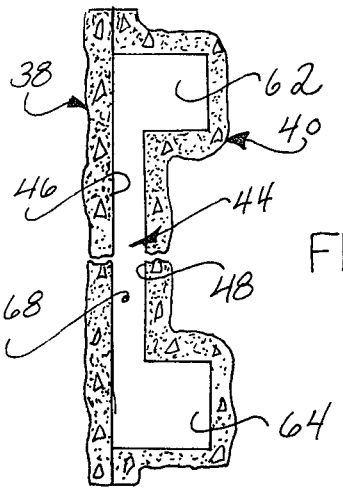
FIG. 4 is a schematic sectional view, generally similar to FIG. 3, illustrating the mold sections in an interconnected condition partially defining a cavity in which a cast product is formed.

After the pattern assembly 10 has been repetitively dipped in liquid ceramic mold material and portions of a wet coating of ceramic material wiped away, the pattern assembly is fired at a relatively high temperature to thoroughly dry the layers of ceramic mold material and to destroy the body 12 of the pattern material. This results in the formation of a pair of rigid ceramic mold sections 38 and 40 (see FIG. 3). After the body 12 of pattern material has been destroyed, the metal reinforcing members 16 and 18 will remain in the space between the mold sections 38 and 40. Once the reinforcing members 16 and 18 have been removed intact without damaging the mold sections 38 and 40, the mold sections are interconnected in the manner shown in FIG. 4 to at least partially define a mold cavity 44 in which a cast product is formed. Thus, the mold section 38 has a surface 46 which partially defines a surface of the mold cavity 44 and a surface 48 which defines another portion of the mold cavity 44. The surfaces 46 and 48 were accurately formed by the surfaces of the body 12 of pattern material.

A plurality of arcuately curved mold sections 38 and 40 are made from reinforced pattern assemblies having the same construction as the pattern assembly 10. The plurality of mold sections 38 and 40 are assembled in a pair of concentric circular arrays in the manner illustrated schematically in FIG. 5 to provide the mold cavity 44 with a circular ring-shaped configuration. Although it is contemplated that the mold sections 38 and 40 can be interconnected in many different ways to form the circular mold cavity 44, the mold sections 38 and 40 are advantageously interconnected in the manner disclosed in the aforementioned Blazek et al. application entitled "Mold Assembly and Method of Making the Same" to form a mold cavity in which a turbine engine component is cast. It should be noted that when the mold sections 38 and 40 are interconnected in circular arrays in the manner illustrated in FIG. 5, the surfaces 46 on the mold sections 38 define a radially inner surface of the circular mold cavity 44 while the surfaces 48 on the outer mold sections 40 define the outer surface of the mold cavity.

In accordance with a feature of the present invention, the relatively rigid metal reinforcing members 16 and 18 retard deflection of the relatively flexible wax or polymeric body 12 of pattern material as the mold assembly is dipped. Of course, retarding flexing or deflection of the body 12 of pattern material during dipping increases the accuracy with which the mold sections 38 and 40 and the product forming surfaces 46 and 48 thereon are formed. Although the extent to which the use of the rigid reinforcing members 16 and 18 will improve the dimensional accuracy with which the mold sections are formed will vary with the size and configuration of the cast product to be formed with the mold sections, in one illustrative instance the diametral error in the formation of a hub wall of a turbine engine fan frame having a diameter of approximately 24 inches was reduced from a diametral error of about 0.360 inches to a diametral error of about 0.027 inches.

The body 12 of wax pattern material (see FIG. 1) includes a pair of arcuately curving generally parallel elongated main or rim sections 52 and 54 which are interconnected by an arcuately curving web or wall section 58. The rim sections 52 and 54 are relatively thick and correspond to relatively wide annular sections 62 and 64 (FIG. 4) of the mold cavity 44. On the other hand, the web section 58 (FIG. 1) is relatively thin and corresponds to a relatively narrow cylindrical section 68 (FIG. 4) of the mold cavity 44. The wiping surfaces 32 and 34 are formed on a pair of arcuately curving flanges 72 and 74 (FIG. 1) which extend outwardly from the rim sections 52 and 54. It should be noted that when the mold sections 38 and 40 are interconnected in the manner illustrated in FIG. 4, the mold sections are moved together from their initial spacial relationship (illustrated in FIG. 3) through a distance equal to the radial thickness of the flanges 72 and 74 so that the ceramic material of the mold section 40 which previously overlay the sides of the flanges 72 and 74 is in abutting engagement with the mold section 38.

Figure 2:
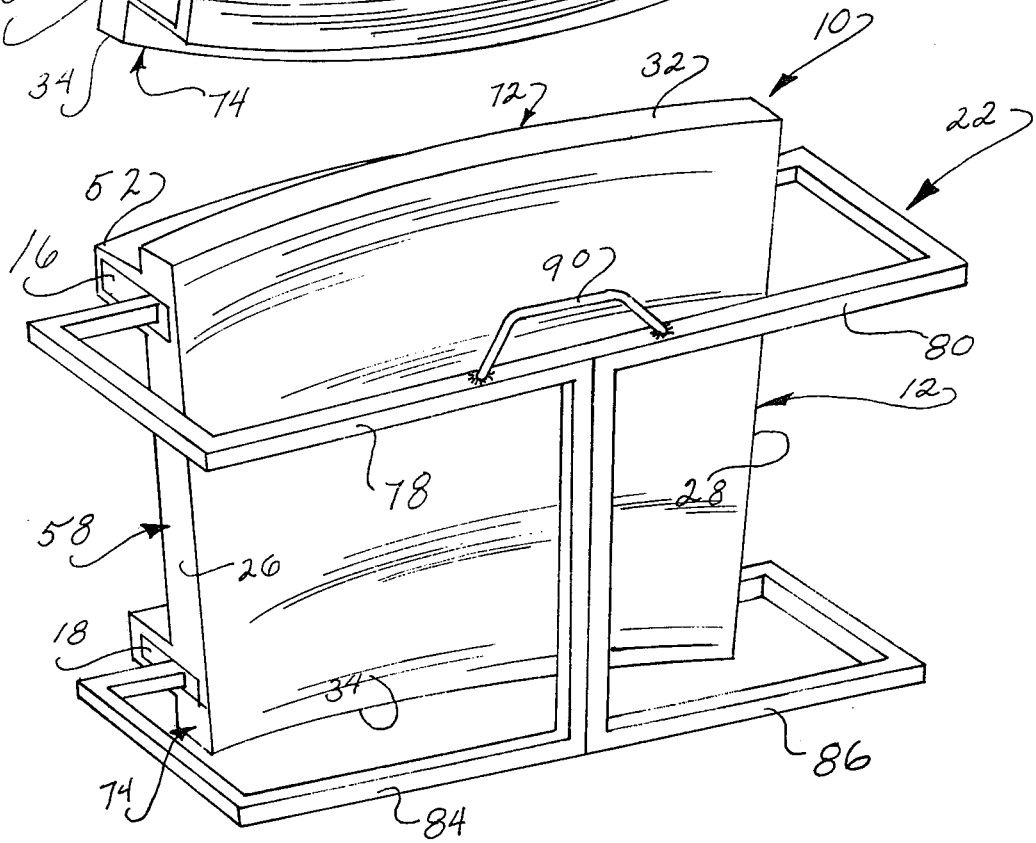
FIG. 2 is a schematic illustration depicting how reinforcing members in the pattern material of the assembly of FIG. 2 are engaged to support the assembly for dipping in liquid ceramic mold material.

Due to the configuration of the pattern assembly 10, the rigid reinforcing members 16 and 18 have an elongated arcuately curving configuration corresponding to the arcuately curving configuration of the rim portions 52 and 54 of the body 12 pattern material (see FIGS. 1 and 2). The reinforcing members 16 and 18 are located in the body 12 of pattern material by positioning them in a suitable die into which molten wax is injected. However, it is contemplated that the body 12 of wax pattern material could be formed with a suitable recess into which a reinforcing member would be inserted after the wax pattern material had been removed from the die. It should be noted that the metal reinforcing members 16 and 18 reduce the amount of wax in the relatively thick main or rim sections 52 and 54 of the body 12 of pattern material to thereby reduce the amount of shrinkage which occurs when the molten wax solidifies.

Once the pattern assembly 10 has been formed in this manner, both ends of each of the longitudinally extending reinforcing members 16 and 18 are engaged by the rigid metal frame 22 to support the pattern assembly 10 for dipping. Thus, the frame 22 (see FIG. 2) includes a pair of rigid upper side members 78 and 80 which are connected with opposite ends of the longitudinally extending metal reinforcing member 16. Rigid lower side members 84 and 86 of the frame 22 are connected with opposite ends of the longitudinally extending metal reinforcing member 18. The side members 78, 70, 84 and 96 of the frame 22 are interconnected by the rigid reinforcing members 16 and 18 to form a rigid structure which prevents deflection of the relatively flexible pattern material 12 during dipping. It is contemplated that with certain pattern assemblies it may be desirable to engage only one end of each reinforcing member rather than both ends as described herein.

The pattern assembly 10 is dipped in a body of liquid ceramic mold material by grasping the handle 90 and lowering the pattern assembly slowly downwardly in a direction extending perpendicular to the central longitudinal axis of the reinforcing members 16 and 18 and parallel to the arcuately curving major side surfaces of the body of pattern material 12. However, with certain pattern assemblies it may be desirable to move the pattern assemblies along paths extending generally parallel to longitudinal axes of reinforcing members as the pattern assemblies are dipped.

After the pattern assembly 10 has been dipped in and removed from the liquid ceramic mold material, the flange surfaces 32 and 34 (FIG. 1) and end surfaces 26 and 28 (FIGS. 1 and 2) are wiped to remove the wet coating of ceramic mold material overlying this portion of the pattern assembly.

The wet ceramic coating is then dried and the pattern assembly 10 is again dipped to form another layer. The dipping, wiping and drying of the pattern assembly 10 is repeated until a covering of ceramic mold material having a desired thickness has been built up on the pattern assembly. The pattern assembly 10 is then heated to a temperature sufficient to melt the wax pattern material 12 to expose the mold surfaces 46 and 48 in the manner illustrated in FIG. 3. The resulting mold sections 38 and 40 can then be moved apart and the rigid reinforcing members 16 and 18 removed while maintaining the accurately formed mold surfaces 46 and 48 intact. Although it is preferred to utilize reusable metal reinforcing members 16 and 18, it is contemplated that the rigid reinforcing members could be formed of a suitable heat destructable material which would be melted at a slightly higher temperature than the pattern material. It is also contemplated that the pattern material could be destroyed by methods other than heating, for example microwaves could be utilized if desired.

Figure 5:
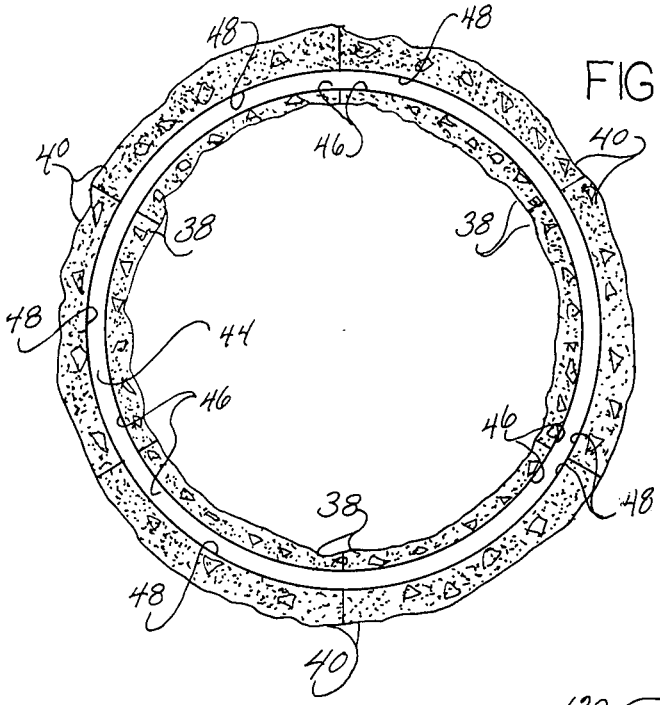
FIG. 5 is a sectional plan view of a mold assembly formed by a plurality of mold sections similar to the mold sections shown in FIG. 4 and defining a generally ring-shaped mold cavity in which a circular cast product is formed.

After a plurality of pattern assemblies of the same construction as the pattern assembly 10 have been dipped, the relatively flexible pattern material destroyed, and the relatively rigid reinforcing members removed, the resulting mold sections 38 and 40 are interconnected in two concentric circular arrays as illustrated in FIG. 5. Suitable gating, such as illustrated in the aforementioned Blazek et al. application, is then connected with the resulting circular mold cavity 44 to conduct molten metal to the mold cavity during a casting operation. After the casing operation has been performed, the mold sections 38 and 40 are removed. The metal in the gating is then cut away and the resulting cast product which was formed in the mold cavity 44 is ready for use or additional processing steps.

In the embodiment of the invention illustrated in FIGS. 1–5 the pattern assemblies 10 have a configuration such that the reinforcing members 16 and 18 are longitudinally extending rods having arcuately curving central axes. However, it is contemplated that other types of reinforcing members could be utilized. For example, in the embodiment of the invention illustrated in FIGS. 6 and 7 a flat metal plate is utilized to reinforce a pair of bodies of flexible pattern material which are disposed on opposite sides of the plate.

Figure 6:
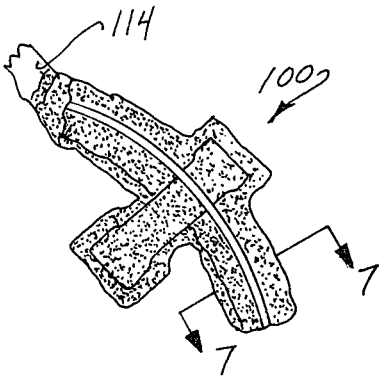
FIG. 6 is an illustration, on a reduced scale, depicting a pattern assembly in which a pair of bodies of relatively flexible and destructable pattern material are mounted on a relatively rigid reinforcing member, the pattern assembly being illustrated after dipping in liquid ceramic mold material.
Figure 7:
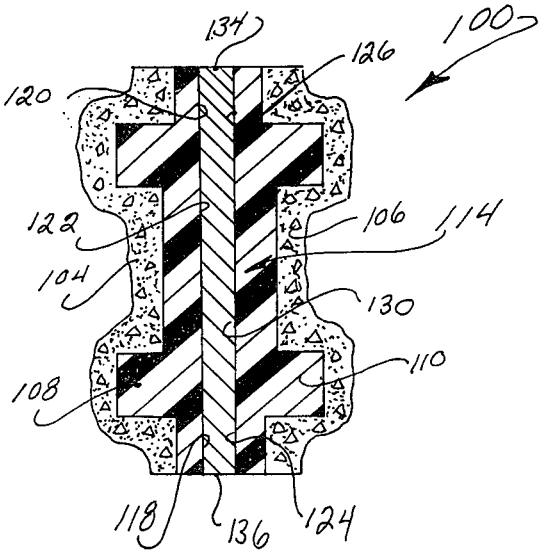
FIG. 7 is an enlarged sectional view, taken generally along the lines 7—7 of FIG. 6, further illustrating the relationship between the relatively rigid reinforcing member and the bodies of relatively flexible pattern material.

A pattern assembly 100 is illustrated in FIGS. 6 and 7 after the pattern assembly has been repetitively dipped in a slurry of ceramic mold material to form multi-layered coverings or mold sections 104 and 106 overlying bodies 108 and 110 of flexible and destructable pattern material, i.e. wax. The bodies of pattern material 108 and 110 are connected to a flat metal plate 114 which reinforces the relatively flexible bodies 108 and 110 of pattern material. Thus, the body 108 of pattern material has flat side surfaces 118 and 120 which are held against a major side surface 122 of the reinforcing member 114. Similarly, flat side surfaces 124 and 126 of the body 110 of pattern material are held against a flat major side surface 130 of the reinforcing member 114.

Each time the pattern assembly 100 is dipped, minor side surfaces similar to the surfaces 134 and 136, of the reinforcing member 114 are wiped to remove the wet coating of ceramic mold material. During this wiping step, the wet coating of mold material was also removed from edge portions of the bodies 108 and 110 of flexible pattern material illustrated in FIG. 7.

When a covering of ceramic mold material of a desired thickness has been built up over outer surfaces of the pattern bodies 108 and 110 by repetitively dipping the pattern assembly 100, the pattern assembly is fired and the pattern bodies 108 and 110 are melted to release the mold sections 104 and 106 from the reinforcing member 114. The mold sections 104 and 106 are advantageously utilized as end caps for a segmented mold assembly in the manner disclosed in the aforementioned Blazek et al. application for "Mold Assembly and Method of Making the Same". However, it should be understood that a reinforcing member similar to the reinforcing member 114 could be utilized to support flexible pattern bodies having many different configurations.

In view of the foregoing, it is apparent that an improved method of making a ceramic mold (FIG. 5) having a cavity 44 in which a cast product is accurately formed includes reinforcing relatively flexible wax pattern material 12 having a configuration which corresponds to the configuration of surfaces 46 and 48 of the mold cavity. The flexible pattern material 12 is supported with relatively rigid reinforcing members 16 and 18 to prevent the pattern material from deflecting during dipping of the pattern assembly 10 in liquid ceramic mold material. Between dipping steps, portions of a wet ceramic coating are wiped away in areas between portions of the wet coating which will eventually form the mold sections 38 and 40. After the ceramic mold material on the body 12 of pattern material has been dried, the pattern material is destroyed by heating or other methods. The resulting mold sections 38 and 40 are then separated and the rigid reinforcing members 16 and 18 removed intact from between the mold sections. The separate mold sections 38 and 40 are interconnected to form a cavity 44 in which a cast product is accurately formed. In one specific case, a plurality of mold sections 38 and 40 were interconnected to form a circular mold cavity for a turbine engine component, i.e. a jet engine fan frame.

Although the use of a pair of reinforcing members 16 and 18 in association with a single body 12 of wax pattern material and the use of a single reinforcing member 114 with a pair of bodies 108 and 110 of wax pattern material have been described herein, it is contemplated that other combinations of reinforcing members and bodies of pattern material could be utilized if desired. In fact, a relatively thin coating of wax pattern material over a metal plate can be utilized as a pattern assembly to accurately form mold surfaces. It should be understood that although the ceramic mold sections 38 and 40 have been utilized to define a circular mold cavity, reinforced pattern assemblies constructed in accordance with the present invention could be utilized to form molds having cavities with many different types of configurations.

I claim:

1. A method of making at least a portion of a ceramic mold having a cavity for accurately forming a cast product and gating through which material can flow toward the cavity during the casting of the product, said method comprising the steps of forming a pattern assembly which at least partially defines a surface of the mold cavity in which the cast product is to be formed, said step of forming the pattern assembly including the steps of providing relatively flexible and destructable pattern material and a pair of relatively rigid members for reinforcing at least a portion of the pattern material which at least partially defines the surface of the mold cavity, said step of providing pattern material including the step of providing a body of pattern material having a pair of spaced apart and relatively thick main sections which at least partially correspond to a pair of spaced apart and relatively wide sections of the mold cavity in which the cast product is formed, said main sections of pattern material being interconnected by a relatively thin web section which at least partially corresponds to a relatively narrow section of the mold cavity in which the cast product is formed, said step of providing a pair of reinforcing members including the steps of providing a first reinforcing member connected with a first one of the main sections of pattern material and providing a second reinforcing member connected with a second one of the main sections of pattern material, repetitively dipping the pattern assembly in liquid ceramic mold material to form a covering of ceramic mold material overlying at least a portion of the pattern assembly, retarding deflection of the relatively flexible pattern material with the rigid reinforcing member during said dipping steps, destroying the pattern material to expose a ceramic mold material surface which defines at least a portion of the surface of the mold cavity in which the cast product is formed, and removing the reinforcing members from the ceramic mold material.

2. A method as set forth in claim 1 further including the step of supporting the pattern assembly during said dipping steps by engaging opposite end portions of the first one of said reinforcing members.

3. A method as set forth in claim 1 wherein the reinforcing members have elongated configurations, said dipping steps including moving the pattern assembly into and out of the liquid ceramic mold material along a path extending transversely to the longitudinal axes of the elongated reinforcing members.

4. A method as set forth in claim 1 further including the step of at least partially supporting the pattern assembly during said dipping steps by engaging an end portion of said first reinforcing member and by engaging an end portion of said second reinforcing member.

5. A method as set forth in claim 1 further including the step of at least partially supporting the pattern assembly during said dipping steps by engaging opposite end portions of said first reinforcing member and by engaging opposite end portions of said second reinforcing member.

6. A method as set forth in claim 1 wherein said first and second reinforcing members have longitudinally extending central axes, said dipping steps including the step of moving the pattern assembly into and out of the liquid ceramic mold material along a path extending transversely to the central axes of said first and second reinforcing members.

7. A method as set forth in claim 1 further including the step of removing at least a portion of a wet coating of ceramic mold material from an area overlying the pattern assembly and circumscribing the web section of pattern material immediately after performing at least some of said dipping steps.

8. A method as set forth in claim 1 further including the step of removing at least a portion of a wet coating of ceramic mold material from a portion of the pattern assembly after at least some of said dipping steps, said step of removing the reinforcing member including separating ceramic mold material on one side of an area where a wet coating of ceramic mold material was removed from ceramic mold material on another side of the area where the wet coating of ceramic mold material was removed.

9. A method as set forth in claim 1 wherein said step of removing the reinforcing members is performed after said step of destroying the pattern material and includes the step of moving the reinforcing members away from the ceramic mold material while maintaining the reinforcing members intact.

10. A method of making ceramic mold for accurately forming a cast product having a generally ring-shaped cross sectional configuration, said method comprising the steps of forming a plurality of pattern assemblies, said step of forming a plurality of pattern assemblies including the steps of providing a plurality of arcuately curved bodies of relatively flexible and destructable pattern material each of which has a surface area with a configuration similar to the configuration of a portion of the surface area of the cast product and providing a plurality of relatively rigid arcuately curved members which reinforce at least a portion of an associated one of the bodies of pattern material, each of said arcuately curved reinforcing members having substantially the same curvature as the associated bodies of pattern material, repetitively dip coating each of the pattern assemblies in liquid ceramic mold material to form a covering of ceramic mold material overlying at least a portion of each of said plurality of pattern assemblies, retarding deflection of the bodies of relatively flexible pattern material with the rigid reinforcing members during said dipping steps, providing a plurality of separate mold sections each of which has a surface area with a configuration similar to the configuration of a portion of the surface area of the cast product by destroying the bodies of pattern material and removing the reinforcing members, and interconnecting the mold sections to at least partially define a mold cavity, said step of interconnecting the mold sections including the step of placing the mold sections in a generally circular array to at least partially define a generally ring-shaped mold cavity.

11. A method as set forth in claim 10 further including the step of supporting each of the pattern assemblies during the dipping steps by engaging the reinforcing members.

12. A method of making ceramic mold for accurately forming a cast product having a generally ring-shaped cross sectional configuration, said method comprising the steps of forming a plurality of pattern assemblies, said step of forming a plurality of pattern assemblies including the steps of providing a plurality of bodies of relatively flexible and destructable pattern material each of which has a surface area with a configuration similar to the configuration of a portion of the surface area of the cast product and providing a plurality of relatively rigid members which reinforce at least a portion of an associated one of the bodies of pattern material, said step of providing a plurality of bodies of pattern material including the step of providing a plurality of bodies of pattern material each of which has a pair of spaced apart and relatively thick arcuately curved main sections which at least partially correspond to a pair of spaced apart and relatively wide arcuately curved sections of the mold cavity in which the cast product is formed, said main sections of pattern material being interconnected by a relatively thin arcuately curved web section which corresponds to a relatively narrow section of the mold cavity in which the cast product is formed, said step of providing a plurality of reinforcing members including the step of providing an arcuately curved reinforcing member in association with each of said main sections of pattern material, repetitively dip coating each of the pattern assemblies in liquid ceramic mold material to form a covering of ceramic mold material overlying at least a portion of each of said plurality of pattern assemblies, retarding deflection of the bodies of relatively flexible pattern material with the rigid reinforcing members during said dipping steps, providing a plurality of separate mold sections each of which has a surface area with a configuration similar to the configuration of a portion of the surface area of the cast product by destroying the bodies of pattern material and removing the reinforcing members, and interconnecting the mold sections to at least partially define a mold cavity.

13. A method as set forth in claim 12 further including the step of supporting each of the pattern assemblies during the dipping steps by engaging the reinforcing members.

14. A method as set forth in claim 12 wherein said step of interconnecting the mold sections includes placing the mold sections in a generally circular array to at least partially define a generally circular mold cavity.

* * * * *

UNITED STATES PATENT AND TRADEMARK OFFICE

CERTIFICATE OF CORRECTION

PATENT NO. : 4,043,379
DATED : August 23, 1977
INVENTOR(S) : William S. Blazek

It is certified that error appears in the above-identified patent and that said Letters Patent are hereby corrected as shown below:

Column 7, line 50, change "member" to --members--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*